US007526983B1

(12) United States Patent
Tipotsch

(10) Patent No.: US 7,526,983 B1
(45) Date of Patent: May 5, 2009

(54) TOOL FOR REMOVING AND INSTALLING A POP-UP POOL CLEANING HEAD ASSEMBLY

(76) Inventor: Donald Gene Tipotsch, 965 N. Salem Cir., Mesa, AZ (US) 85205

( * ) Notice: Subject to any disclaimer, the term of this patent is extended or adjusted under 35 U.S.C. 154(b) by 0 days.

(21) Appl. No.: 11/759,111

(22) Filed: Jun. 6, 2007

Related U.S. Application Data

(63) Continuation-in-part of application No. 11/679,740, filed on Feb. 27, 2007.

(51) Int. Cl.
*B25B 13/48* (2006.01)

(52) U.S. Cl. ..... 81/176.15; 464/88; 81/177.6; 81/177.2

(58) Field of Classification Search ..... 81/176.1, 81/176.15, 176.2, 177.6, 177.1, 177.2; 403/277, 403/281, 282, 297; 285/223, 235, 144.1, 285/148.3; 464/87–88
See application file for complete search history.

(56) References Cited

U.S. PATENT DOCUMENTS

| | | | | |
|---|---|---|---|---|
| 1,458,894 | A | 6/1923 | Schwarz | |
| 1,772,915 | A | 8/1930 | Roseberg | |
| 2,080,627 | A | 5/1937 | Morgan | |
| 2,174,010 | A | 9/1939 | Patterson | |
| 2,409,385 | A * | 10/1946 | Pletcher | 81/477 |
| 2,451,438 | A | 10/1948 | Hartman | |
| 2,704,005 | A * | 3/1955 | Clayson | 81/177.6 |
| 2,824,434 | A | 2/1958 | Stern | |
| 2,860,495 | A | 11/1958 | Stark | |
| 2,896,431 | A | 7/1959 | Stillwagon, Jr. | |
| 3,332,255 | A | 7/1967 | Seagreaves et al. | |
| 3,623,339 | A | 11/1971 | Muller | |
| 3,742,789 | A * | 7/1973 | Rusk et al. | 81/176.15 |
| 3,747,367 | A | 7/1973 | Muller | |
| 4,392,464 | A * | 7/1983 | Woodward et al. | 123/196 R |
| 4,487,591 | A | 12/1984 | Berg | |
| 4,836,065 | A * | 6/1989 | Setliff | 81/124.2 |
| 4,939,797 | A | 7/1990 | Goettl | |
| 6,412,373 | B1 | 7/2002 | Hsiao | |
| 6,629,478 | B2 * | 10/2003 | Kozak | 81/490 |
| 6,952,986 | B2 | 10/2005 | Fu | |
| 6,971,281 | B1 * | 12/2005 | Jarvis | 81/3.08 |

* cited by examiner

*Primary Examiner*—D. S Meislin
(74) *Attorney, Agent, or Firm*—Veronica-Adele R. Cao; Weiss & Moy, P.C.

(57) ABSTRACT

A tool for removing and installing a pop-up pool cleaning head assembly from a floor fitting is provided. The tool includes a removal head having a top portion with tapered pins or other protrusions that are adapted to engage with the pool cleaning head assembly and a receiver tube for receiving a first end of a substantially short stiff flexible connector, a rigid connector spaced apart from the removal head and having a first portion for receiving a second end of the substantially short stiff flexible connector and a second portion for fastening a pole-type member therein, and a pair of externally threaded tapering pipe plugs fit in the first and second ends of the flexible connector that cooperate with a plurality of bite ribs along an inner wall of the receiver tube and rigid connector first portion to substantially prevent rotation of the removal head.

17 Claims, 9 Drawing Sheets

TOOL FOR REMOVING AND INSTALLING A POP-UP POOL CLEANING HEAD ASSEMBLY

CROSS-REFERENCE TO RELATED APPLICATIONS

This application is a continuation-in-part of U.S. application Ser. No. 11/679,740 filed Feb. 27, 2007 (now pending) by the same named inventor, the application incorporated by reference in its entirety herein for all purposes. This application is also related to application Ser. No. 11/759,113 filed concurrently herewith entitled "Water Volume Controller for Pop-up Pool Cleaning Nozzle" by the same named inventor and incorporated herein by reference.

FIELD OF THE INVENTION

This invention relates generally to a pool cleaning tool. More specifically, this invention relates to a tool for removing and installing a pop-up pool cleaning head assembly from a pool floor fitting.

BACKGROUND OF THE INVENTION

Automatic pool cleaning systems are intended to ease the task of maintaining swimming pool surfaces free of settled debris. Automatic pool cleaning systems use water pressure to clean the pools. Some known systems utilize a plurality of "cleaning heads" installed along the bottom surfaces of swimming pools, wherein the cleaning heads have a large number of outlet openings or orifices so that successive jets of water are ejected along the bottom surfaces of the pool to move debris into the main drain or into suspension where it is removed by the pool skimmer. The position and quantity of cleaning heads depends on the size and shape of the pool.

Pop-up cleaning head assemblies typically include a pop up jet producing nozzle and a stationary section that sealably engages with a pool floor fitting installed in the bottom surface of the swimming pool and is sealably coupled to an intermittent high pressure water supply. As the water pressure is intermittently pressurized, the pop-up jet producing element pops up and down, causing the rotary pop-up element to rotate intermittently each time the water pressure is turned on and off. Each time the water pressure is turned on, a jet of water is ejected from the outlet opening, which is exposed above the edge of the fitting as the pop-up jet producing element pops up. Each time the water pressure is turned off, the jet producing element is retracted into the fitting.

Unfortunately, the pool cleaning head assemblies may sometimes need removal from the floor fitting for repair or replacement due to malfunction, obsolescence, or to change the color to match the pool interior as described in prior application Ser. No. 11/679,740. Prior art removal tools have included those that swivel by the use of bolts, which over time become loose and thus require consistent maintenance. They also have been made from materials that do not withstand pool chemicals and/or ultraviolet light. In addition, their manufacture and assembly requires extensive machining including drilling thus increasing their cost and complexity.

Accordingly, there has been a need for a novel removal tool for installing and removing a pop-up cleaning head assembly which is of simplified construction, relatively inexpensive to manufacture and maintain, and adaptable to engage with a variety of head assemblies for removal from and installation into a pool floor fitting. The present invention fulfills these needs and provides other related advantages.

SUMMARY OF THE INVENTION

The present invention resides in a tool for removing and installing a pop-up pool cleaning head assembly from a pool floor fitting. The tool comprises, generally, a removal head having a top portion adapted to engage with the pop-up pool cleaning head assembly and a receiver tube for fixedly receiving a first end of a flexible connector, a pole-type member having a pole end and a handle end, and a rigid connector fixedly attached at a first portion to a second end of the flexible connector and at an opposite second portion to the pole-type member. The removal tool may further comprise means for substantially preventing rotation of the removal head.

The removal head comprises the top portion having a top and bottom surface, a circumferential skirt which may be joined to and extend down from the top surface, engagement means projecting from the top surface for engaging with the recesses or openings in an annular flange of the pool cleaning head assembly, and the receiver tube. The receiver tube may be joined to and extend downwardly from the bottom surface in substantially the center of an interior area of the removal head. The receiver tube may be provided with a plurality of tapered bite ribs on an interior wall. The top portion has a generally circular outline. A plurality of internal braces defined in the interior area of the removal head radiate from an outer wall of the receiver tube to the inner wall of the circumferential skirt. The internal braces may be arranged in a plurality of spaced configurations and may include at least one boss molded therein. The arrangement may be universally adaptable to remove or install a number of different pool cleaning head assemblies.

The engagement means may be a pair of hemispherical protrusions spaced apart 180 degrees that protrude from the top surface of the removal head top portion and four internal braces equally spaced from each other at about 90 degrees may be provided in the interior area of the removal head top portion. The removal head including the hemispherical protrusions may be a one-piece molding, made from polycarbonate material or the like. The polycarbonate may be substantially clear or translucent to permit the tool user to view the engagement of the protrusions with the recesses in the pool cleaning head assembly. The plurality of protrusions may be sized with a taper slightly larger than the recesses in the top surface of the annular flange to permit a press fit engagement with the pool cleaning head assembly.

In another embodiment of the removal tool, the engagement means may be two or more spaced tapered pins that project from the top surface of the removal head top portion. The pins may be tapered at a free end and each fixed at an opposite end into the at least one boss in the interior area of the removal head top portion.

The flexible connector is provided in the form of a short stiff piece of flexible hydraulic hose or tubing with a minimum hydraulic pressure rating of about 2000 psi and a maximum hydraulic pressure rating of about 3000 psi, preferably 2500 psi.

The rigid connector may be a substantially hollow cylindrical body with a slightly enlarged outer diameter first portion and a second portion. A plurality of bite ribs that taper outwardly toward the second portion may be provided along the inner wall of the first portion. Opposed openings in the second portion of the substantially hollow cylindrical body are provided to receive fastening means for securing the pole end of the pole-type member into the interior of the second portion of the rigid connector.

The means for substantially preventing rotation may comprise a pair of tapering externally threaded socket pipe plugs that may each be turned into the first and second ends of the flexible connector. The pipe plugs may be closely sized to the inner diameter of the flexible connector and press fit therein to provide a substantially flush condition within the first and second ends of the flexible connector. The pipe plugs exert pressure outwardly against the inner wall of the flexible connector and the bite ribs in the receiver tube and in the first portion of the rigid connector cooperatively exert pressure inwardly against the outer wall of the flexible connector. This cooperative arrangement substantially prevents rotation of the removal head.

The pop-up cleaning head assembly may be easily removed from and installed into a floor fitting in the bottom of a swimming pool. To remove from or install the pop-up cleaning head assembly into the pool floor fitting, the protrusions or pins engage with the recesses or openings on the top surface of the annular flange of the pool cleaning head assembly.

The removal tool is used to rotate the assembly so that the upper and lower locking tabs spaced around the outer wall of the internal housing outer cylinder engage and are locked to corresponding locking slots (not shown) on the inside wall of the floor fitting for installation of the pool cleaning head assembly into the floor fitting. The removal tool may also be used to rotate the assembly to disengage the assembly from the floor fitting.

Other features and advantages of the present invention will become apparent from the following more detailed description, taken in conjunction with the accompanying drawings which illustrate, by way of the example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
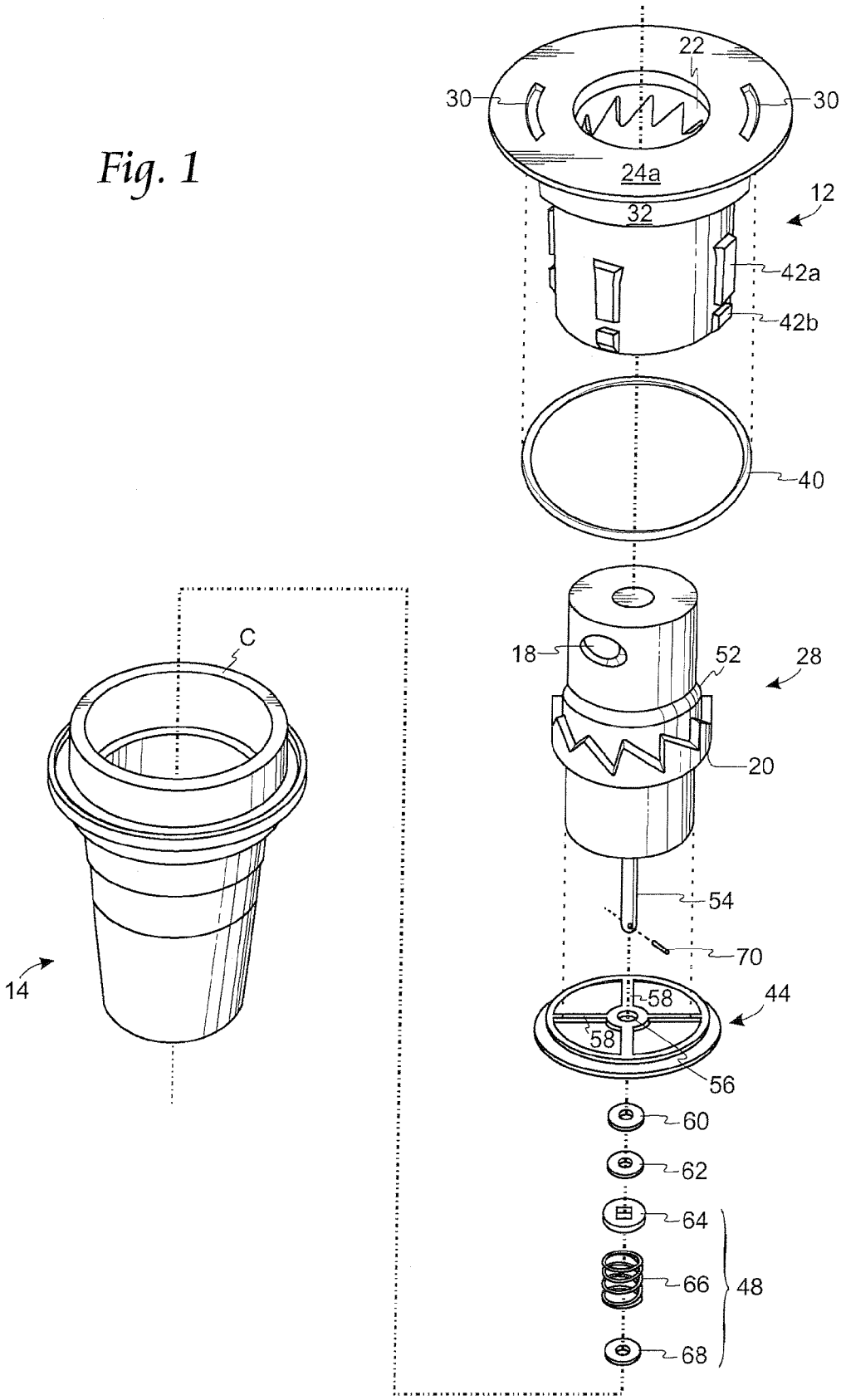
FIG. 1 is an assembly view of a pool cleaner head assembly embodying the invention, illustrating the pool cleaner head assembly installed into an exemplary floor fitting, a nozzle assembly received in an internal housing to form the pool cleaner head assembly.

As shown in the drawings for purposes of illustration, the present invention is concerned with an improved tool for removing and installing a pool cleaning head assembly from and into a floor fitting, generally designated in the accompanying drawings by the reference number 100. The tool comprises, generally, a removal head 102 having a top portion 104 adapted to engage with the pool cleaning head assembly 10 and a receiver tube 106 for receiving a first end 108 of a relatively short substantially stiff flexible connector 110, a rigid connector 112 spaced apart from the removal head and having a first portion 114 for receiving a second end 116 of the relatively short substantially stiff flexible connector and a second portion 118 for fastening a pole-type member 120 thereon. The tool may further comprise a pair of externally threaded tapering pipe plugs 122 in the first and second ends 108 and 116 of the flexible connector 110 that cooperate with a plurality of bite ribs 124*a* and 124*b* along an inner wall 125 of the receiver tube 106 (124*a*) and rigid connector first portion 114 (124*b*) to substantially prevent rotation of the removal head 102.

In accordance with the present invention, and as illustrated with respect to a preferred embodiment in FIGS. 1 through 19, the removal tool permits substantially easy and fast removal and installation of a pop-up pool cleaning head assembly 10 out of and into a pool floor fitting 14. The term "removal tool" as used herein refers to a tool that both removes and installs a pop-up pool cleaning head assembly out of and into the pool floor fitting.

Figure 2:
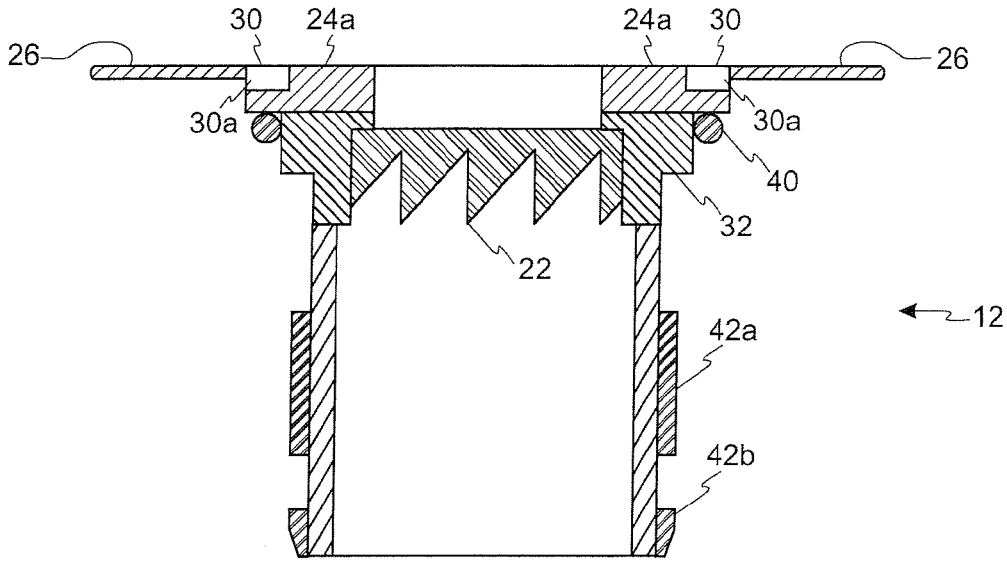
FIG. 2 is a sectional view of the internal housing of the pool cleaner head assembly of FIG. 1.

The pool cleaning head assembly 10 as shown in FIGS. 1 and 2 comprises a substantially cylindrical internal housing 12 adapted to be connected in sealed relationship with a floor fitting 14 and a rotary pop-up nozzle assembly 16 which rotates and vertically reciprocates within the substantially cylindrical internal housing 12, the rotary pop-up nozzle assembly 16 having a plurality of offset nozzle orifices 18 and a lower camming ring 20 which engages with an upper camming ring 22 disposed around the inner wall of the substantially cylindrical internal housing 12 when the rotary pop-up nozzle assembly 16 is in an elevated position to eject water from the plurality of offset nozzle orifices 18. The internal housing 12 may further comprise an annular flange 24 with an extended lip portion 26 to overlie a color ring "c" of the floor fitting 14.

As shown in FIG. 2, the substantially cylindrical internal housing 12 functions as a stationary hollow cylinder within which a nozzle body 28 of the pop-up nozzle assembly 16 rotates and vertically reciprocates. The annular flange 24 defines the upper end of the internal housing 12. The annular flange has a top surface 24*a*, a bottom surface 24*b*, an inner cylindrical wall 24*c* which defines the inside diameter of the upper end of the internal housing and an outer cylindrical wall 24*d*. The annular flange 24 may include the outwardly extended lip portion 26 adapted to cover a floor fitting color ring (not shown) as hereinafter described. The outer edge of the extended lip portion may be tapered downwardly for a smooth transition to the pool bottom surface to substantially prevent a swimmer from stubbing his or her toes on the pool cleaning head. A plurality of recesses 30 or openings may be disposed in the top surface 24*a* of the annular flange to engage with the removal tool as described hereinafter. The depth of the plurality of recesses may extend substantially the height of the annular flange 24. The plurality of recesses may include a side opening 30*a* in the outer cylindrical wall of the annular flange 24. Although a pair of hemispherical recesses 30 spaced apart at a 180 degree angle are shown in FIG. 1, it is to be appreciated that substantial benefit may be derived from changing the number, the shape and/or spacing of the plurality of recesses.

As shown in FIG. 2, a collar 32 is provided below the annular flange 24. The collar includes an inner cylindrical wall 34 and an outer cylindrical wall 36. The inside diameter of the collar increases to a substantially uniform inside diameter below an upper end of the collar to define a square edge 38 for purposes as described hereinafter. The collar has a substantially uniform outside diameter. The collar 32 retains an O-ring 40 between the exposed bottom surface 24*b* of the annular flange and the floor fitting 14. The O-ring 40 provides a substantially water-tight seal between the floor fitting 14 and the internal housing 12, but could be substituted with another type of soft sealing element as hereinafter described. The upper camming ring 22 may be disposed around the inner cylindrical wall of the collar below the upper end. In a preferred embodiment, the upper camming ring 22 has twelve teeth that extend around the inner circumference of the internal housing. While twelve teeth have been provided, it is to be appreciated that substantial benefit may be achieved by the use of other number of teeth. The internal housing including the teeth may be molded in one piece from plastic such as ABS (Acrylonitrile butadiene styrene) plastic or the like.

Figure 6:
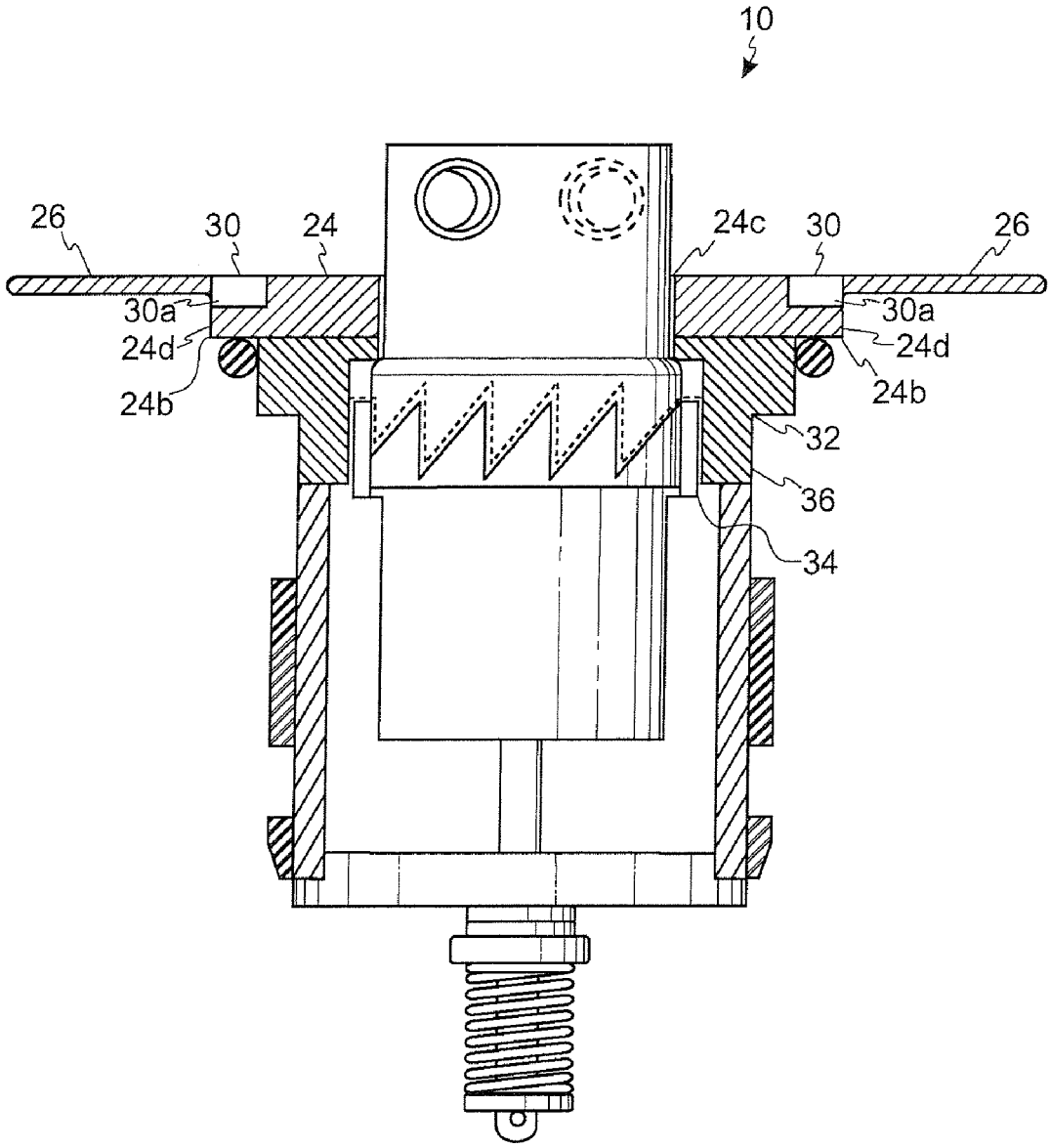
FIG. 6 is a sectional view of the pool cleaner head assembly, illustrating the nozzle assembly in an elevated position in the internal housing with the pair of nozzle orifices exposed above the top of the internal housing.
Figure 7:
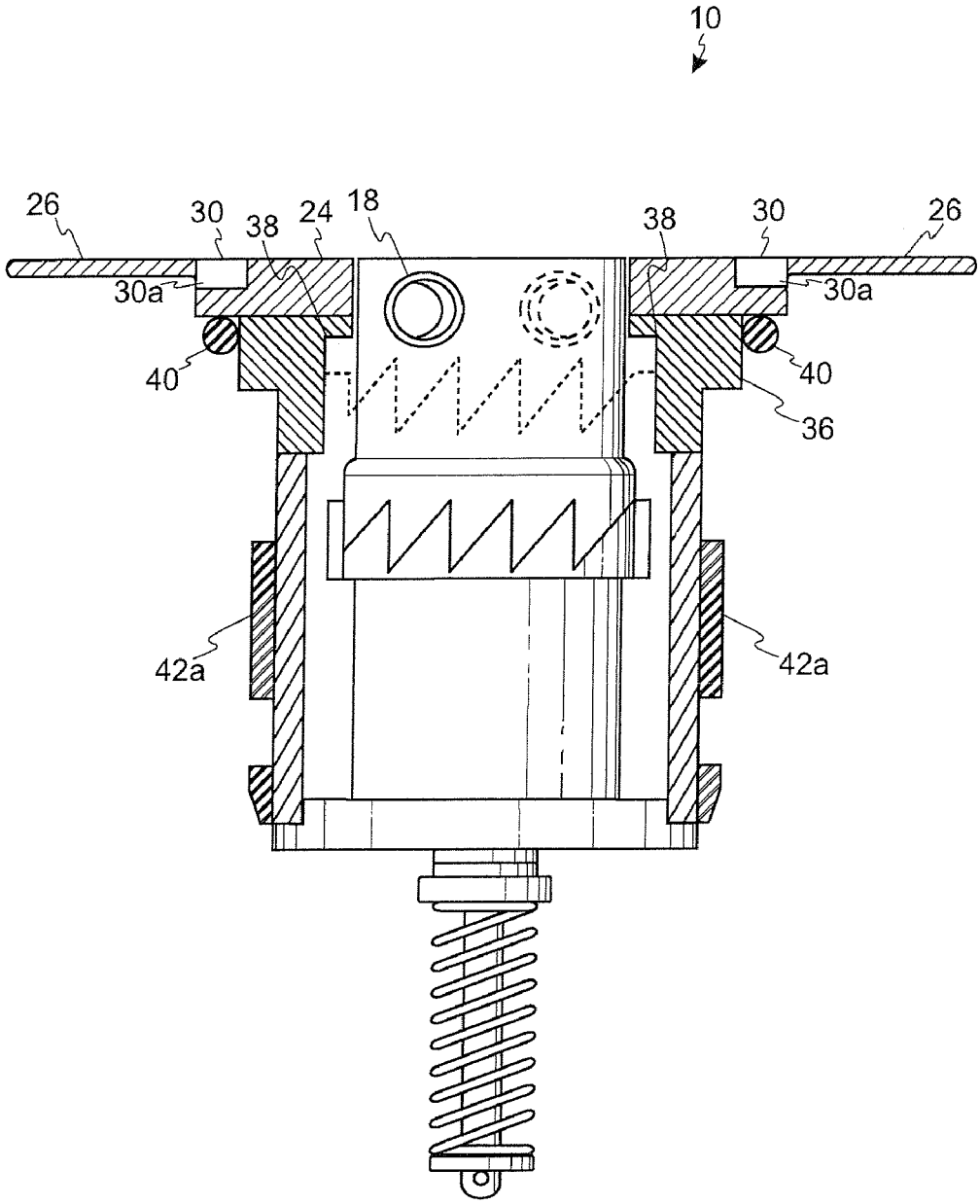
FIG. 7 is a sectional view similar to FIG. 6, illustrating the nozzle assembly in a retracted position in the internal housing.

A lower portion of the substantially cylindrical internal housing 12 includes spaced-apart upper and lower locking tabs 42*a* and 42*b* along the outer cylindrical wall for purposes as described hereinafter. While the spaced-apart locking tabs shown in FIG. 2 define two step portions for purposes as described hereinafter, it is to be appreciated that substantial benefit may be achieved by the use of locking tabs of other configurations or by other known locking methods well known in the art (e.g. threads, adhesive, etc.). As shown in FIGS. 6 and 7, a guide washer 44 may be affixed into the bottom of the internal housing 12 of the pool cleaning head assembly 10.

Figure 3:
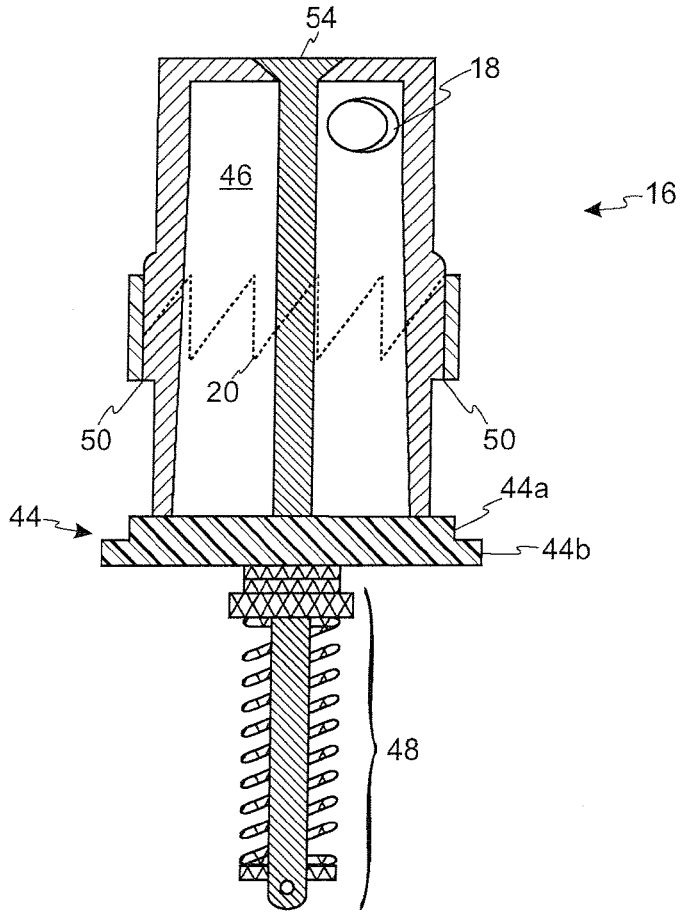
FIG. 3 is a sectional view of the nozzle assembly of FIG. 1.
Figure 4:
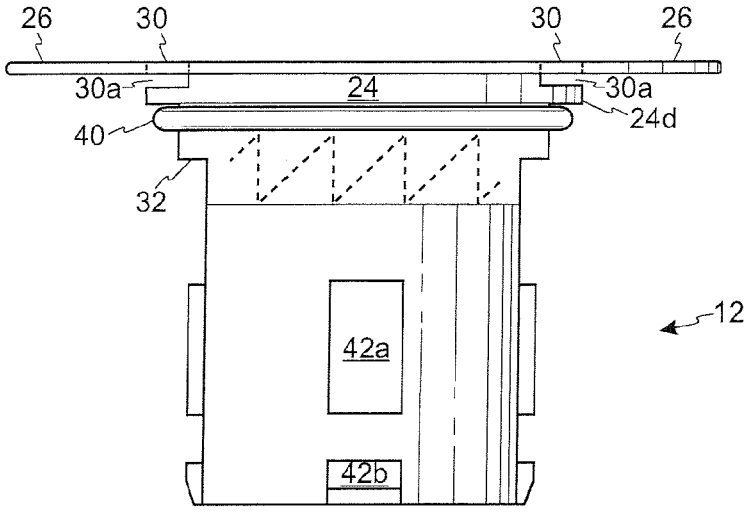
FIG. 4 is a side external view of the internal housing of FIG. 2, illustrating by dotted lines an upper camming ring inside the internal housing of FIG. 2.
Figure 5:
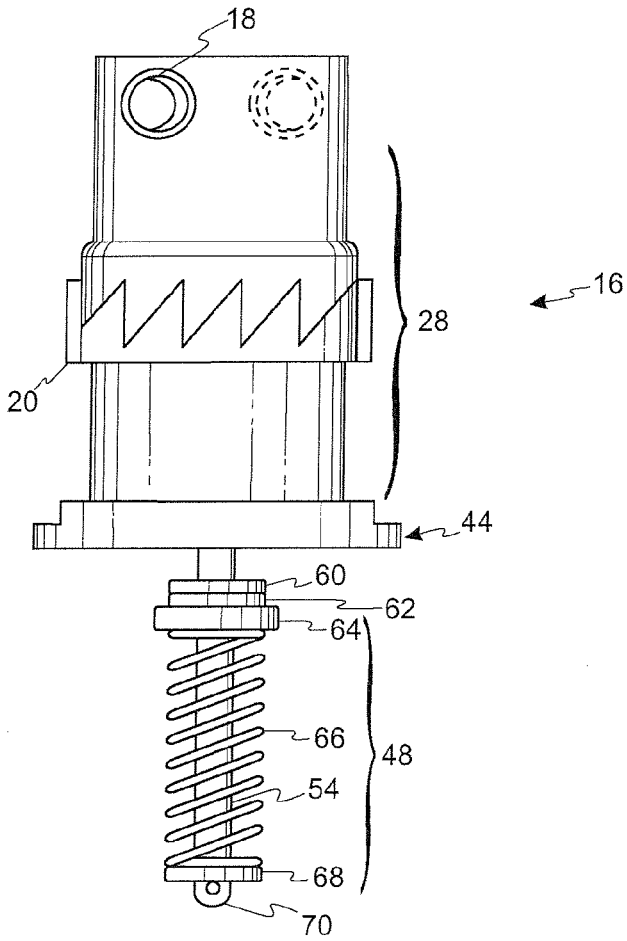
FIG. 5 is a side external view of the nozzle assembly of FIG. 3, illustrating a lower camming ring and a pair of nozzle orifices.

As shown in FIG. 3, the rotary pop-up nozzle assembly 16 comprises the hollow cylindrical nozzle body 28 with an upwardly tapered inner core 46 and a spring assembly 48. The inside diameter of the hollow cylindrical nozzle body 28 decreases from the bottom of the nozzle body toward the top of the nozzle body before becoming of uniform inside diameter just below the nozzle orifices 18 to define the upwardly tapered inner core 46. The upward tapering of the inner core 46 defines a "compression zone" near the pair of nozzle orifices 18 such that the water is forced through the nozzle orifices at a higher pressure thus making cleaning easier and faster i.e. laminar flow may be increased with turbulence near the nozzle orifices decreased. The hollow cylindrical nozzle body 28 has an upper portion closed at the top and a lower portion open at the bottom. An enlarged outer diameter middle portion 50 intermediate the upper and lower portions may be defined by an outer cylindrical wall of the hollow cylindrical nozzle body 28 protruding outwardly with a radius edge (i.e. a rounded edge) 52 and then inwardly a spaced distance below the radius edge to provide the lower portion with substantially the same inner and outer diameter as the upper portion of the hollow cylindrical body. The radius edge 52 substantially prevents water blowby between the nozzle body 28 and the internal housing 12 (i.e. around the circumference of the rotary pop-up nozzle). Water blowby may be substantially prevented when the radius edge 52 contacts the square edge 38 when the pop-up nozzle body 28 is in the elevated position as hereinafter described and as shown in FIG. 6. Water blowby undesirably causes a decrease in water pressure which prevents the pop-up nozzle body 28 from fully rotating.

The lower camming ring 20 may be disposed around the outer cylindrical wall of the middle portion 50 of the hollow cylindrical nozzle body 28. The outer diameter of the lower camming ring 20 is selected to provide a slight clearance with the inner cylindrical wall of the collar when the nozzle is in an elevated position as hereinafter described so that sand and debris from the pool are not trapped between the camming rings 20 and 22 and the inner cylindrical wall of the collar. The lower camming ring 20 has a plurality of teeth corresponding to the number of teeth in the upper camming ring 22. The pop-up nozzle including the teeth may be molded in one piece from plastic such as ABS (Acrylonitrile butadiene styrene) plastic or the like.

The nozzle orifices 18 may be disposed through the upper section of the rotary pop-up nozzle body 28. While a pair of nozzle orifices is shown, it is to be appreciated that substantial benefit may be achieved by providing more than two nozzle orifices. The nozzle orifices may be offset, tangent to the inside wall of the nozzle to provide a balanced rotation of the nozzle body 28 around a fixed center shaft 54 toward the upper camming ring 22. The centrifugal force at the perimeter of the nozzle causes rotation.

The fixed center shaft 54 extends the length of the hollow cylindrical nozzle body 28 and downwardly therefrom. The fixed center shaft 54 may be substantially rigid. The center shaft has a square cross section and chamfered edges at the closed top of the nozzle body 28 as shown in FIG. 3. The guide washer 44 is disposed on the center shaft below the lower portion of the hollow cylindrical body of the nozzle. The guide washer 44 has a smaller diameter upper portion 44*a* and a larger diameter lower portion 44*b*. The guide washer 44 has a substantially round, centrally located opening 56 therein with cross-bars 58 extending radially therefrom through which the fixed center shaft 54 passes downwardly. The bottom of the hollow cylindrical nozzle body 28 sits on the top of the cross-bars 58 of the guide washer 44 when the nozzle is in a retracted position as shown in FIG. 7. Two washers 60 and 62, preferably stainless steel are disposed on the center shaft 54 below the guide washer 44. The two washers 60 and 62 provide a reduced friction bearing surface.

An upper washer 64, preferably plastic, with a centrally located square opening therein is disposed on the center shaft below the two washers 60 and 62. A compression spring 66 may be disposed on the center shaft between the upper washer 64 and a lower washer 68. The spring is preferably stainless steel. The lower washer 68 is preferably stainless steel and may be retained on the lower end of the center shaft by means of a pin 70, preferably a stainless steel pin. The upper and lower washers 64 and 68, the spring 66 and the pin 70 are collectively referred to herein as "the spring assembly 48." Because the upper washer 64 has a square, centrally located opening therein, and the center shaft 54 has a square cross-section, the spring assembly 48 rotates at the same rate that the pop-up nozzle body 28 rotates. This prevents the spring from "winding up" as the pop-up nozzle body 28 rotates.

The rotary pop-up nozzle body 28 fits into and moves as a piston within the internal housing 12. Without water pressure, the rotary pop-up nozzle body is in its lowered position within the internal housing 12 as shown in FIG. 7. Clearance between the internal housing and the rotary pop-up nozzle body 28 permits the nozzle to move freely. The top of the pop-up nozzle body 28 is flush with the top of the internal housing 12 when in the lowered position.

If the water pressure is then increased, the spring 66 is compressed and the pop-up nozzle body 28 rapidly moves upward to its elevated position as shown in FIG. 6. In the elevated position, the lower and upper camming rings 20 and 22 engage and a high pressure jet of water is ejected from the pair of nozzle orifices 18. The middle portion 50 of the nozzle body is received within the inner cylindrical wall of the collar 32 below the upper end such that the radius edge 52 contacts the square edge 38 of the collar. The spring 66 then expands with the pop-up nozzle body 28 moving downward, returning into the substantially cylindrical internal housing as shown in FIG. 7.

As the water pressure is intermittently pressurized, the pop-up nozzle body 28 pops up and down in the internal housing, locks in position in the camming rings, then relaxes and unwinds to the next set of teeth. The balanced centrifugal force from the tangential orifices in the nozzle make the nozzle rotate. The stainless steel washers 60 and 62 lower the friction and the upper plastic washer 64 with the square central opening unwinds the spring tension in one direction allowing the nozzle to relax to its newly assumed position.

Figure 8:
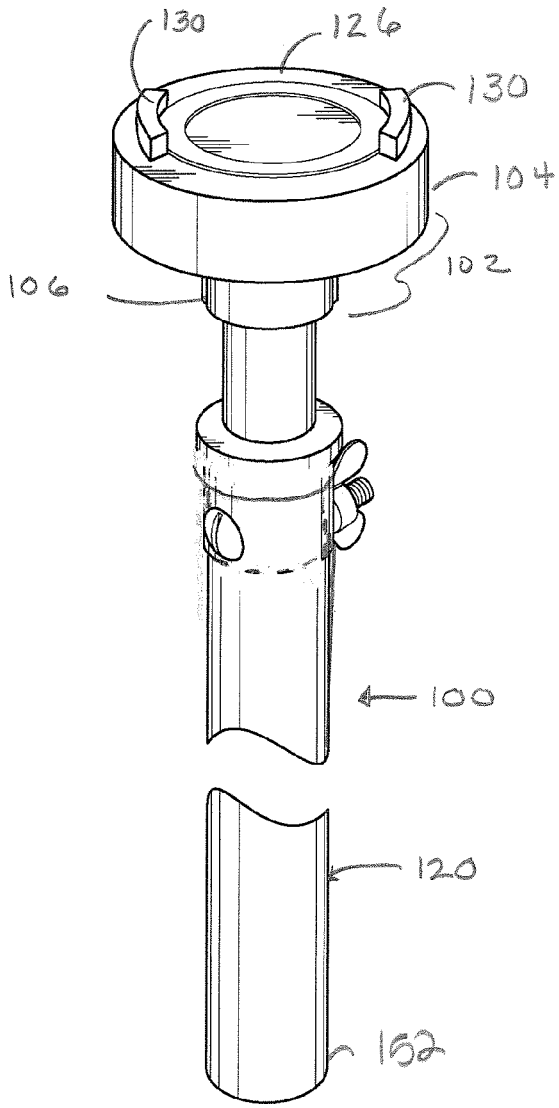
FIG. 8 is a perspective view of one embodiment of a removal tool embodying the invention, illustrating the removal tool having a removal head having a top portion with a pair of hemispherical protrusions on a top surface thereof and a receiver tube for receiving a first end of a flexible connector, a pole-type member having a pole end and a handle end, and a rigid connector spaced apart from the removal head and having a first portion for receiving a second end of the flexible connector and an opposite second portion for fastening the pole end of the pole-type member.
Figure 9:
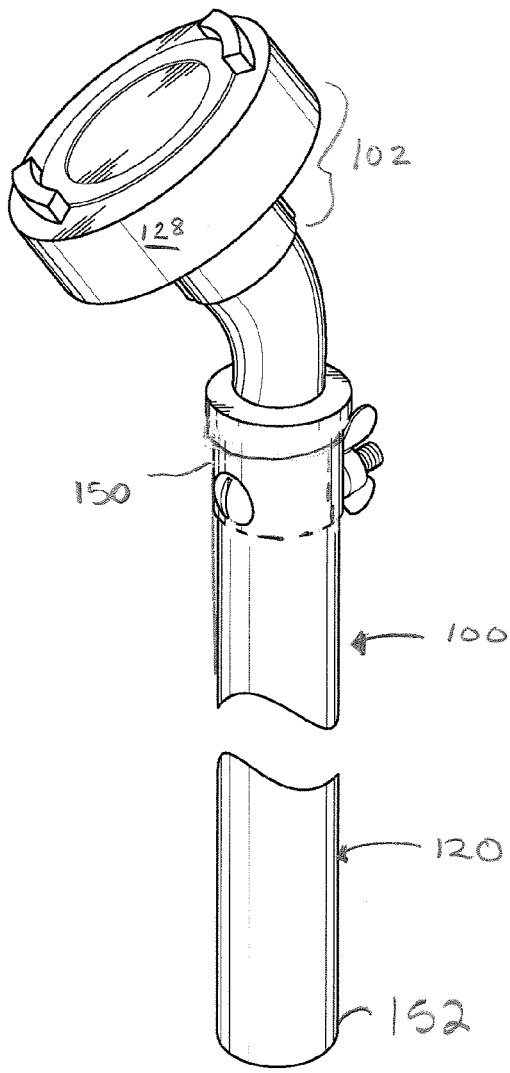
FIG. 9 is another perspective view of the removal tool of FIG. 8, illustrating the controlled flexibility of the removal tool.

As shown in FIGS. 8 and 9, the tool removal head 102 comprises the top portion 104 having a top 126 and bottom surface (not shown), a circumferential skirt 128 which may be joined to and extend down from the top surface 126, a plurality of protrusions 130 or pins 132 extending from the top surface 126, and the receiver tube 106. The top portion 104 has a generally circular outline. The receiver tube 106 may be joined to and extend downwardly from the bottom surface in substantially the center of an interior area 134 of the removal head 102. The receiver tube may be provided with the plurality of bite ribs 124*a* that taper outwardly toward the bottom of the receiver tube (See FIG. 17) along an inner wall 125 (FIGS. 11-16) thereof. The taper decreases and thus the inner diameter of the receiver tube increases toward the bottom of the receiver tube (at the lead in for the flexible connector) for purposes as hereinafter described. The outer diameter of the flexible connector and the inner diameter of the receiver tube should be closely sized to within 0.020 inches. The bite ribs 124*a* may be equally spaced. A plurality of internal braces 136 defined in the interior area 134 of the removal head 102 radiate from an outer wall 127 of the receiver tube to an inner wall 138 of the circumferential skirt. The plurality of internal braces 136 may extend substantially the same height or less than the height of the circumferential skirt. The internal braces may be arranged in a plurality of spaced configurations and may include at least one boss 140 that extends substantially the internal brace height. The at least one boss 140 may be substantially cylindrical and taper-bored during the molding process for the reception of at least one tapered pin 132 as hereinafter described. The at least one boss 140 may be positioned at the inner wall 138 of the circumferential skirt or interiorly therefrom depending on the spacing of the at least one tapered pin 132.

Figure 12:
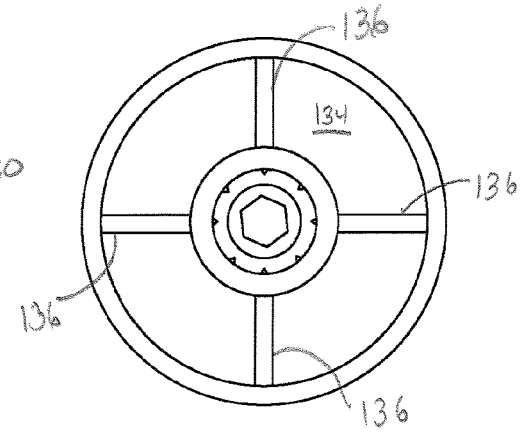
FIG. 12 is a bottom view of the removal head of FIGS. 8-11, illustrating a plurality of bite ribs along an inner wall of the receiver tube and a plurality of equally spaced internal braces within an interior of the top portion of the removal head.
Figure 13:
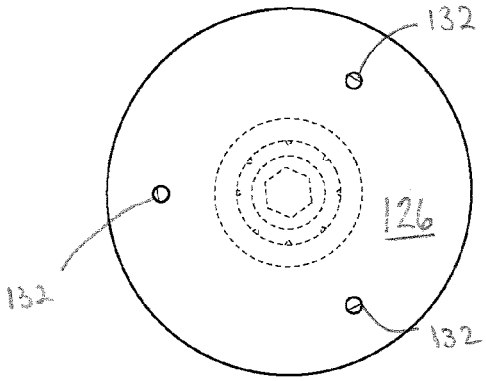
FIG. 13 is a top view of another embodiment of the removal head, illustrating three equally spaced pins that project from the top surface of the top portion of the removal head.
Figure 14:
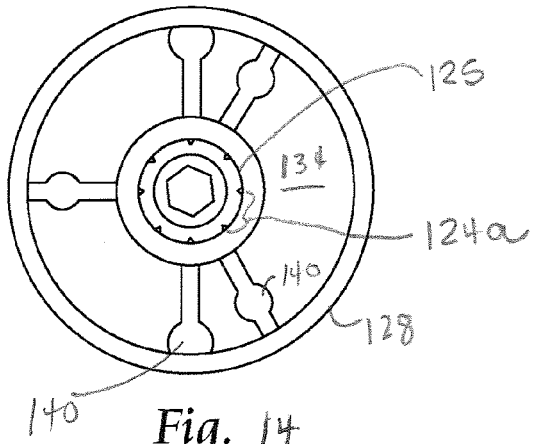
FIG. 14 is a bottom view of the three pin removal head of FIG. 13.

In a first embodiment of the removal tool as shown in FIGS. 8-12, the pair of hemispherical protrusions 130 may be spaced apart 180 degrees and protrude from the top surface 126 of the removal head top portion 104 and four internal braces 136 equally spaced from each other at about 90 degrees are provided in the interior area 134 of the removal head top portion 104 (FIG. 12). At least one of the four internal braces may include a boss (not shown). The removal head including the hemispherical protrusions may be a one-piece molding, made from polycarbonate material or the like. The material may be substantially clear or translucent to permit the tool user to view the engagement of the protrusions with the recesses in the pool cleaning head assembly. Although a pair of hemispherical protrusions are described, it is to be appreciated that substantial benefit may be derived from changing the number, the shape and/or spacing of the plurality of protrusions from the top surface of the removal head top portion depending on the number, shape and/or spacing of the plurality of recesses 30 in the top surface 24*a* of the annular flange 24 of the pool cleaning head assembly 10. The plurality of protrusions may be sized slightly larger than the recesses in the top surface of the annular flange with a taper to permit initial engagement which becomes tighter as the protrusions are fully inserted into the recesses. This pressure helps keeps the removal head engaged with the pool-cleaning head assembly.

Figure 15:
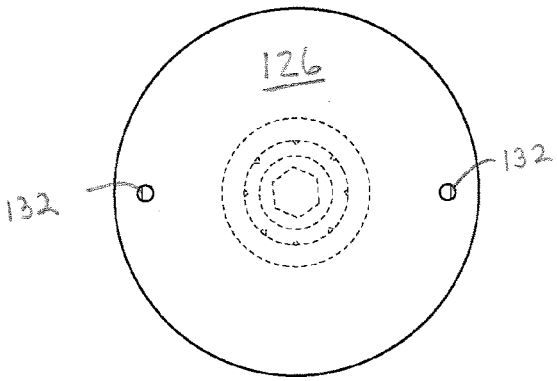
FIG. 15 is a top view of another embodiment of the removal head, illustrating two equally spaced pins that project from the top surface of the top portion of the removal head.
Figure 16:
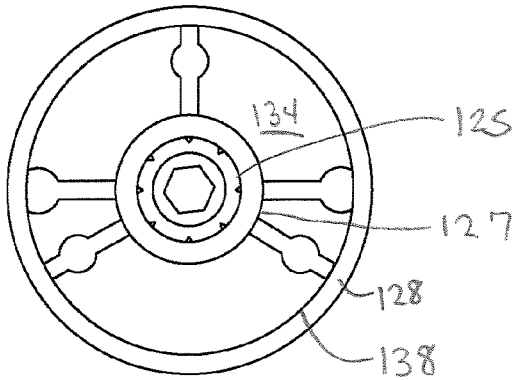
FIG. 16 is a bottom view of the two pin removal head of FIG. 15.
Figure 19:
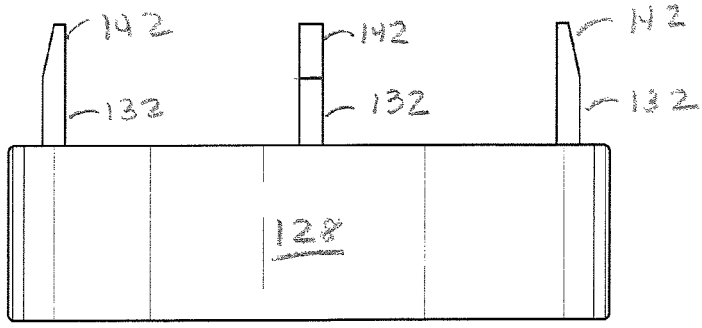
FIG. 19 is an elevational view of the top portion of the removal head of FIGS. 13 and 14.

In other embodiments of the removal head as shown in FIGS. 13-16 and 19, two or more tapered pins 132 may project or protrude from the top surface of the removal head top portion that are adapted to engage with the recesses or openings in the annular flange of the pool cleaning head assembly. The recesses or openings may be bored or molded openings in the annular flange of the pool cleaning head assembly. FIG. 19 shows three tapered pins projecting from the top surface of the removal head top portion and equally spaced at 120 degrees. FIG. 15 shows two tapered pins equally spaced about 180 degrees apart. The pins 132 may be tapered at a free end 142 (See FIG. 19 for purposes as hereinafter described and fixed at an opposite end into an equal number of bosses 140 that are correspondingly spaced. The pins may be stainless steel or the like to withstand the harsh conditions within a pool (e.g. chlorine, etc.) Although two and three pin removal heads are shown, it is to be appreciated that substantial benefit may be derived from adjusting the number and/or spacing thereof depending on the number and/or spacing of the plurality of recesses or openings in the top surface of the annular flange of the pool cleaning head assembly.

A single removal head having internal brace and boss configurations such as shown in FIGS. 7 and 9 permit adjustment of the number and spacing of the tapered pins in a single removal head thus reducing inventory for different removal heads to fit different pool cleaning assemblies. Either of the illustrated configurations permits a two, three or more pin design. The internal brace and boss configuration may be adjusted to the number and spacing of the pins, which depends on the number and spacing of the recesses or openings in the top surface of the annular flange of the pool cleaning head assembly. The plurality of bosses permits use of the removal head on pool cleaning head assemblies with various recess patterns.

The flexible connector 110 is provided in the form of a short stiff piece of flexible hose or tubing. The short length and stiffness of the flexible connector provide improved adaptability and maneuverability for the removal tool while substantially minimizing significant flexion of the tool. The flexible connector is preferably a rubber hydraulic or heater hose having a minimum hydraulic pressure rating of about 2000 psi and a maximum hydraulic pressure rating of about 3000 psi, preferably about 2500 psi. The flexible connector may also be a short piece of teflon lined hydraulic hose, a rubber hose having a fabric braid or the like on its exterior, a steel mesh hydraulic hose, metal hose or any other suitable hose or tubing that will provide flexibility yet is substantially stiff or rigid so that the flexible connector will not flex (i.e. decreased torsion), particularly important while using the tool to remove or install a pool cleaning head assembly from a floor fitting at the bottom of a pool with the removal head at the end of a pole-type member that may be about 10 feet to about 12 feet long. In a preferred embodiment, a Dayton Hose AX8 3000# hydraulic hose may be used. While such a hose has been described, it is to be appreciated that substantial benefit may be derived from using a different type of hose or tubing. The first end of the flexible connector may be inserted into the receiver tube and the second end of the flexible connector into the first portion of the rigid connector by a vise or hydraulic piston.

The rigid connector 112 may be a substantially hollow cylindrical body with the slightly enlarged outer diameter first portion 114 and the second portion 118. The juncture between the slightly enlarged outer diameter first portion and the second portion defines a lip 119 for stopping the pole-type member into position as hereinafter described. The plurality of bite ribs 124*b* may be provided along the inner wall of the first portion. The plurality of bite ribs 124*b* taper outwardly toward the second portion. The taper increases and thus the inner diameter decreases toward the bottom of the rigid connector (See FIG. 17). The rigid connector 112 and removal head 102 are spaced apart so a section of flexible connector between the first and second ends thereof is exposed to provide some flexibility and maneuverability to the tool (See FIGS. 8 and 9). Opposed openings (not shown) in the second portion 118 of the rigid connector are provided to receive a bolt 146 or the like for securing the pole-type member 120 around the second portion of the rigid connector as hereinafter described. A wing nut 148 or the like may secure the bolt 146 in the opposed openings. The rigid connector may be a one-piece molding, made from polycarbonate material or the like.

The pair of tapering externally threaded socket pipe plugs 122 may each be turned into the first and second ends 108 and 116 of the flexible connector 110. The pipe plug turned into the first end 108 may be inserted smaller end first into the second end 116, but is then moved into position within the first end 108 of the flexible connector. The other pipe plug may then be turned smaller end first into the second end 116. The pipe plugs may be available from A & M Nut and Bolt, Phoenix, Ariz. Suitable tapered pipe plugs are available in nominal sizes from 1/16 to 2 inches with an external thread and made from stainless steel, brass or other materials that may substantially withstand pool chemicals and ultraviolet light degradation. The pipe plugs are closely sized to the inner diameter of the flexible connector and press fit therein to provide a substantially flush condition with a surface friction hold within the first and second ends of the flexible connector For example, the smaller end of the pipe plug may be about 0.002 inches larger than the internal diameter of the flexible connector. The pipe plugs 122 exert pressure outwardly against the inner wall of the flexible connector and the bite ribs in the receiver tube and the first portion of the rigid connector 124*a* and 124*b* cooperatively exert pressure inwardly against the outer wall of the flexible connector. The taper of the pipe plugs may be in the same direction as the tapering of the respective bite ribs. This cooperative arrangement substantially prevents rotation of the removal head. The tapered pipe plugs may be temporarily removed from the removal tool to permit the flexible connector to be replaced if necessary.

While tapered pipe plugs have been described, substantial benefit may be derived by using tapered fixing pins (not shown) to fix the flexible connector into position. A hydraulic press may be used to push the fixing pins into position. With the use of tapered fixing pins rather than the pipe plugs, the flexible connector may not be replaceable.

A preferred flexible connector may be a hydraulic hose having an inner diameter of about 0.50 inches, an outer diameter of about 0.75 inches, and a length preferably between about two to about 2.5 inches, preferably about 2.1 inches long. The preferred pipe plug for a 0.50 ID flexible connector may be a ¼" NPT (Nipple pipe thread) pipe plug, which actually measures closer to 0.502 inches. The preferred tool has a receiver tube with an inner diameter of about 0.759 inches without the plurality of bite ribs 124*a*. With the bite ribs 124*a*, the inner diameter of the receiver tube may be about 0.720 inches at the top of the receiver tube (i.e. near the bottom surface of the top portion) and about 0.690 inches at the bottom of the receiver tube where the taper is largest. The inner diameter of the first portion of the rigid coupling with the bite ribs 124*b* may be about 0.755 inches and about 0.925 inches for the second portion thereof. The outer diameter of the second portion may be about 1.120 inches. While a removal tool having these measurements is described herein, substantial benefit may be derived from a removal tool with different measurements to provide about 0.060 inches to about 0.075 inches of crush or pressure around the flexible connector and enough bite or friction to substantially prevent rotation of the removal head relative to the rest of the removal tool as can be determined from one skilled in the art.

Figure 10:
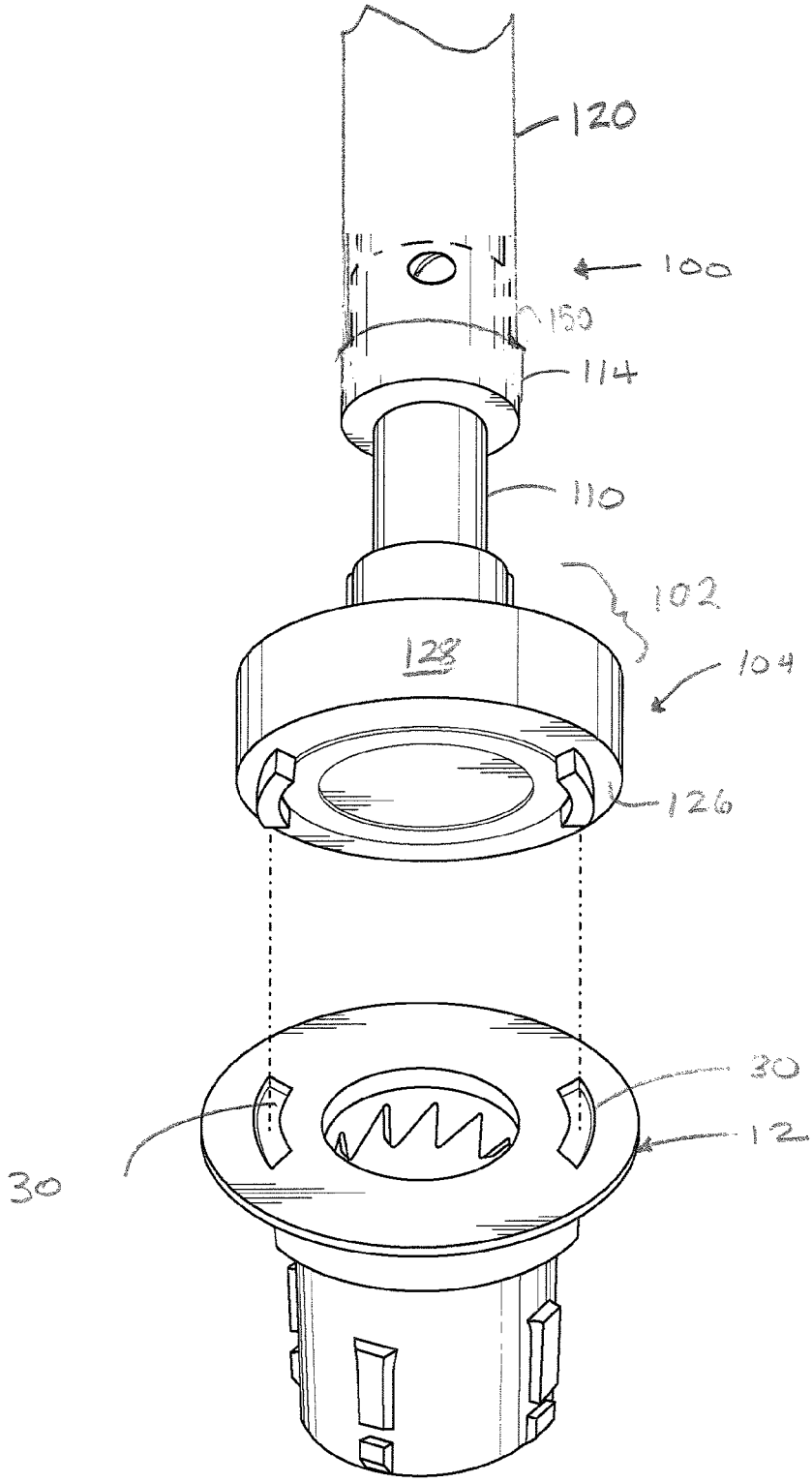
FIG. 10 is an operational view of the removal tool of FIGS. 8 and 9, illustrating the pair of hemispherical protrusions engaging with the recesses in the annular flange of the pop-up pool cleaning head assembly.
Figure 11:
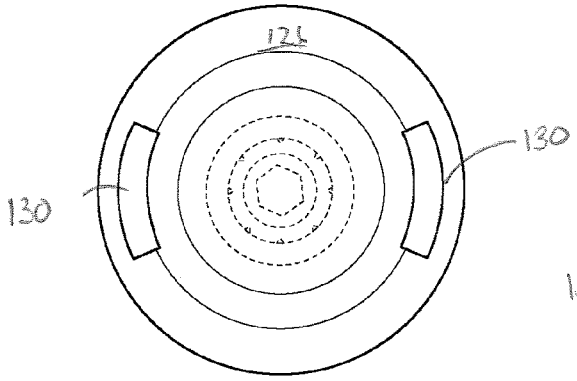
FIG. 11 is a top view of the removal head of FIGS. 8-10.
Figure 17:
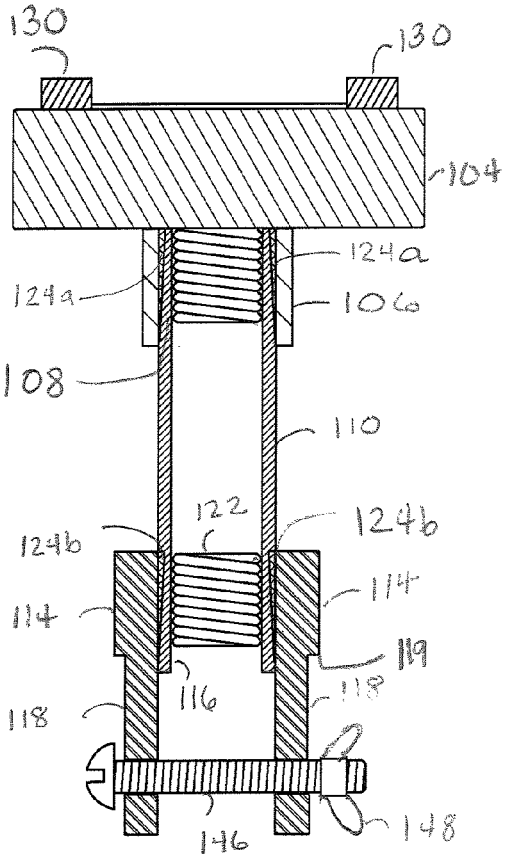
FIG. 17 is a sectional view of the removal tool of FIGS. 8-9 without the pole-type member.
Figure 18:
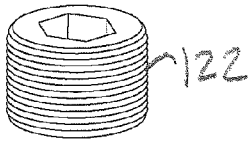
FIG. 18 is a perspective view of a tapered externally-threaded socket pipe plug.

The pole-type member has a pole end 150 and a handle end 152. The pole-type member may be a composite material or another material known to withstand pool chemicals, physical wear, and ultraviolet light degradation. At least the pole end of the pole-type member may be hollow to receive the second portion of the rigid connector as shown in FIG. 10. The pole end of the pole-type member may be fastened around the second portion of the rigid connector with the lip 119 (See FIG. 17) providing a stop for positioning of the pole end around the second portion. A preferred fastening arrangement uses a ¼ inch bolt with a wing nut. Although a bolt 146 and wing nut 148 are shown in FIGS. 8-9 and 17, it is to be appreciated that any suitable fastening means may be used to secure the pole end 150 of the pole-type member 120 around the second portion 118 of the rigid connector. Fastening of the pole end around the second portion rather than inside the second portion substantially increases the strength of the tool and lowers tension and pressure on the rigid connector. While such an arrangement has been described, it is to appreciated that substantial benefit may be achieved by fastening the pole-end inside the second portion of the rigid coupling. The length of the pole-type member should be sufficiently long to reach the bottom of the pool. The fastening means may preferably be stainless steel to withstand pool chemicals.

The pop-up cleaning head assembly 10 may be easily removed from and installed into a floor fitting 14 in the bottom of a swimming pool. To remove the pop-up cleaning head assembly from the floor fitting, the removal tool protrusions 130 or pins 132 engage with the recesses or other openings on the top surface 24*a* of the annular flange of the pool cleaning head assembly to apply torque to disengage the locking tabs from the floor fitting. The size of the protrusions and taper of the free ends of the pins permit the pins to be initially inserted and then tightened into the recesses or openings as they are pushed fully therein. The pop-up cleaning head assembly 10 can then be removed from the floor fitting 14 and lifted out of the water and removed from the pool. The pop up nozzle assembly 16 and internal housing 12 may be replaced as required. To remove the pool cleaning head assembly 10, the pop-up nozzle assembly should be in the retracted position with the cleaning pump (not shown) turned off.

The removal tool may be used in the same manner to install the pop-up pool cleaning head assembly. The removal tool protrusions or pins engage with the recesses or openings on the top surface 24*a* of the annular flange to hold the head assembly. After inserting the head assembly into the open upper end of the floor fitting, the removal tool is used to rotate the assembly so that the upper and lower locking tabs 40*a* and 40*b* spaced around the outer wall of the internal housing outer cylinder engage and are locked to corresponding locking slots (not shown) on the inside wall of the floor fitting. Alternatively, the removal tool may be used to rotate the assembly so that threads around the outer wall of the internal housing threadly engage with the floor fitting. The removal tool may be disengaged from the pop-up pool cleaning head assembly by rotating in the opposite direction that the pool head assembly rotates.

From the foregoing, it is to be appreciated that the improved removal tool of the present invention provides versatility in its ability to be adapted to a variety of pool cleaning head assemblies thus substantially eliminating the need for additional tools depending on the particular head assembly to be removed. The improved removal tool permits continued use without the tool joints loosening up over time from pool chemicals, physical wear and ultraviolet light degradation. The improved removal tool permits improved maneuverability. Although a particular embodiment of the invention has been described in detail for purposes of illustration, various modifications may be made without departing from the spirit and scope of the invention. Accordingly, the invention is not to be limited, except as by the appended claims.

I claim:

1. A tool for removing and installing a pool cleaning head assembly from and into a pool floor fitting, comprising:

a removal head having a top portion with engagement means adapted to engage with the pool cleaning head assembly and a receiver tube for receiving a first end of a substantially stiff flexible connector;

a rigid connector spaced apart from the removal head and having a first portion for receiving a second end of the substantially stiff flexible connector and a second portion for fastening a pole-type member thereon; and means for substantially preventing rotation of the removal head relative to the substantially stiff flexible connector;

wherein the means for substantially preventing rotation of the removal head comprises a pair of externally threaded tapering pipe plugs in the first and second ends of the flexible connector that cooperate with a plurality of bite ribs along an inner wall of the receiver tube and the rigid connector first portion to substantially prevent rotation of the removal head.

2. The tool of claim 1 wherein said substantially stiff flexible connector is steel reinforced elastomeric material.

3. The tool of claim 1 wherein said substantially stiff flexible connector is about two to about 2.5 inches long.

4. The tool of claim 1 wherein the engagement means comprises a plurality of protrusions extending from a top surface of the top portion of the removal head and equally spaced from one another.

5. The tool of claim 4 wherein the plurality of protrusions comprises a pair of hemispherical protrusions spaced apart at 180 degrees.

6. The tool of claim 5 wherein the pair of hemispherical protrusions are dimensioned to be tapered slightly larger than a pair of recesses in the pool cleaning head assembly for press fit engagement therein.

7. The tool of claim 1 wherein the inner diameter of the receiver tube and the outer diameter of the substantially stiff flexible connector are closely sized to within 0.02 inches.

8. The tool of claim 1 wherein the removal head is a one-piece clear or translucent molding.

9. A tool for removing and installing a pop-up pool cleaning assembly in a pool floor fitting, comprising:

a substantially stiff piece of flexible hose having a first end and a second end;

a removal head having a top portion with a plurality of protrusions adapted to engage with the pool cleaning head assembly and a receiver tube for receiving the first end of the flexible hose, the receiver tube having bite ribs along an inner wall;

a rigid coupling spaced apart from the removal head and having a first portion and a second portion, the first portion having bite ribs along a inner wall and the second end of the flexible hose received in the first portion of the rigid coupling;

a pole-type member having a pole end and a handle end, the pole end fastened around a second portion of the rigid coupling; and a pair of externally threaded pipe plugs inside the first and second ends of the flexile hose to cooperatively bear against the bite ribs on the inner wall of the receiver tube and the first section of the rigid coupling to substantially prevent rotation of the removal head relative to the flexible hose.

10. The tool of claim 9 wherein said flexible hose is a piece of hydraulic hose having a hydraulic pressure rating between 2000 psi and 3000 psi.

11. The tool of claim 9 wherein said flexible hose is steel reinforced elastomeric material.

12. The tool of claim 9 wherein said piece of flexible hose is between two to about 2.5 inches long.

13. The tool of claim 9 wherein the plurality of protrusions extend from a top surface of the top portion of the removal head and are equally spaced from one another.

14. The tool of claim 13 wherein the plurality of protrusions comprises a pair of hemispherical protrusions spaced apart at 180 degrees and dimensioned to be sized slightly larger than a pair of recesses in the pool cleaning head assembly for press fit engagement therein.

15. The tool of claim 14 wherein the removal head and pair of hemispherical protrusions comprise a one-piece clear or translucent molding.

16. The tool of claim 13 wherein the outer diameter of each of the pipe plugs and the inner diameter of the flexible hose and the outer diameter of the flexible hose and the inner diameter of the receiver tube and rigid coupling are closely sized to provide about 0.060 to about 0.075 inches of interference on the first and second ends of the flexible hose.

17. A tool for removing and installing a pool cleaning head assembly from and into a pool floor fitting, comprising:

a removal head having a top portion with engagement means adapted to engage with the pool cleaning head assembly and a receiver tube for receiving a first end of a substantially stiff flexible connector, wherein the engagement means comprises a plurality of protrusions extending from a top surface of the top portion of the removal head and equally spaced from one another;

wherein the plurality of protrusions comprises a pair of hemispherical protrusions spaced apart at 180 degrees and are dimensioned to be tapered slightly larger than a pair of recesses in the pool cleaning head assembly for press fit engagement therein;

a rigid connector spaced apart from the removal head and having a first portion for receiving a second end of the substantially stiff flexible connector and a second portion for fastening a pole-type member thereon; and means for substantially preventing rotation of the removal head relative to the substantially stiff flexible connector.

* * * * *